US010328553B1

(12) United States Patent
Pearson

(10) Patent No.: US 10,328,553 B1
(45) Date of Patent: Jun. 25, 2019

(54) ADJUSTABLE OPEN ENDED WRENCH WITH BIDIRECTIONAL RELEASE ACTION

(71) Applicant: Rune S. Pearson, Katy, TX (US)

(72) Inventor: Rune S. Pearson, Katy, TX (US)

( * ) Notice: Subject to any disclaimer, the term of this patent is extended or adjusted under 35 U.S.C. 154(b) by 0 days.

(21) Appl. No.: 14/824,058

(22) Filed: Aug. 11, 2015

(51) Int. Cl.

| | |
|---|---|
| ***B25B 13/16*** | (2006.01) |
| ***B25B 13/48*** | (2006.01) |
| ***B25B 23/14*** | (2006.01) |
| ***B25B 23/142*** | (2006.01) |

(52) U.S. Cl.
CPC ..... *B25B 13/16* (2013.01); *B25B 13/481* (2013.01); *B25B 23/141* (2013.01); *B25B 23/142* (2013.01)

(58) Field of Classification Search
CPC ..... B25B 13/16; B25B 13/481; B25B 23/141; B25B 23/142
USPC ..... 81/473, 158, 129
See application file for complete search history.

(56) References Cited

U.S. PATENT DOCUMENTS

| | | | | |
|---|---|---|---|---|
| 885,596 | A * | 4/1908 | Frey | B25B 13/14 81/158 |
| 1,428,546 | A | 9/1922 | Johnston | |
| 3,858,465 | A * | 1/1975 | Lind | B25B 13/46 81/129 |
| 3,862,582 | A * | 1/1975 | Nockleby | B25B 13/5058 81/168 |
| 4,446,766 | A * | 5/1984 | Lucey | F01D 25/34 74/96 |
| 6,151,996 | A | 11/2000 | Whiteford | |
| 6,568,300 | B1 | 5/2003 | Steffe | |
| 8,485,073 | B1 | 7/2013 | Lopez | |
| 8,925,426 | B2 | 1/2015 | Shishkin et al. | |
| 2011/0239832 | A1 | 10/2011 | Arbel et al. | |

* cited by examiner

*Primary Examiner* — Hadi Shakeri
(74) *Attorney, Agent, or Firm* — Kenneth A. Roddy

(57) ABSTRACT

An adjustable open ended wrench having adjustable gripping jaws that grip inch or metric sized nuts or bolts and provides bidirectional release action of the gripping jaws that allows the user to loosen or tighten the nut or bolt without having to remove the wrench. The wrench is particularly suited for accessing nuts or bolts or nuts that are located in areas where rotational action is very restricted and may be provided with an adjustable torque release spring biased ball detent mechanism that can be set to release the grip of the gripping jaws if the gripping force exceeds a predetermined amount to prevent damage to the nut or bolt due to over tightening.

3 Claims, 4 Drawing Sheets

ADJUSTABLE OPEN ENDED WRENCH WITH BIDIRECTIONAL RELEASE ACTION

CROSS REFERENCE TO RELATED APPLICATION

This application claims priority of U.S. Provisional Patent Application Ser. No. 61/999,222 filed on Aug. 11, 2014.

BACKGROUND OF THE INVENTION

1. Field of the Invention

This invention relates generally to open ended sliding jaw wrenches, and, more particularly to an adjustable open ended wrench having adjustable gripping jaws that grip inch or metric sized nuts or bolts and provides bidirectional release action of the gripping jaws and, in one embodiment, allows adjustment of the amount of torque to be applied to release the grip of the gripping jaws if the gripping force exceeds a predetermined amount.

2. Background Art

Wrenches of many types have been devised for turning a fastener such as a nut or bolt. One common type of wrench is an open ended wrench having a fixed jaw opening that is sized to accommodate either inch or metric sized nuts and bolts. Another common type of adjustable wrench, known as a crescent wrench, has a movable jaw that allows the user to place the jaws around the head of a nut or bolt, and adjust the jaws to fit as tightly as possible around the nut or bolt. The wrench is then used to turn the nut or bolt by moving the handle, which will turn the jaws and thereby the fastener itself. In many instances working in tight quarters, the wrench cannot be turned 360°, but must be removed from the fastener and repositioned so that several smaller arcs are utilized to achieve the number of revolutions necessary to loosen or tighten the fastener. This requires that, for each of the tightening arcs of the wrench, the jaws must be removed from the nut or bolt and then repositioned for the next stroke thereof. Besides the time-consuming problems associated with this motion, the jaws can become loose to the point where they do not sufficiently grasp the nut or bolt and consequently require frequent tightening during the process of turning a fastener.

Most commercially available open ended fixed jaw wrenches and adjustable jaw crescent wrenches do not provide a bidirectional release action of the gripping jaws and thus, are not particularly suited for use in tight quarters or where access to the fitting is limited, such as for example, replacing hoses and connectors for bathroom and kitchen sinks. Because of the very limited working space under typical sinks, particularly kitchen sinks having garbage disposals, the commonly available tools such as the typical fixed jaw open ended wrench, and adjustable jaw crescent wrench, are awkward or simply unusable.

There are several patents directed toward open ended fixed jaw wrenches and adjustable jaw crescent wrenches that provide a ratcheting action of the gripping jaws. The following are several examples of such devices.

Johnston, U.S. Pat. No. 1,428,546, discloses an automatic wrench having a fixed jaw structure including a casing with a hand grip, a sliding jaw structure including a shank rigid therewith for reciprocation in the casing, and having a hand engaging member projecting from a side of the casing for movement of the sliding jaw structure relative to the fixed jaw structure, spring means in the casing for normally forcing the sliding jaw toward the fixed jaw, and spring controlled plunger means in the casing including a portion projecting from the hand grip for manual depression to lock the same in engagement with the sliding jaw structure.

Whiteford, U.S. Pat. No. 6,151,996, discloses an open-end sliding jaw wrench which is self-adjusting, clamps at least four sides surfaces of a nut or bolt head, and is adjustable to fit a range of sizes.

Steffe, U.S. Pat. No. 6,568,300, discloses an adjustable wrench having a ratcheting feature by which its movable jaw retracts away from its fixed jaw when the handle is pulled in one direction, enabling the wrench to slip over the facets of a polygon-shaped nut, but which locks the jaws in position when the wrench handle is turned in the opposite direction. A jaw adjustment screw is positioned for rotation in the wrench head and is axially movable with the lower jaw, but only when a support wedge is slidingly retracted out from its normal position supporting the bottom end of the adjustment screw. An optional feature includes a locking device to prevent the wedge from retracting, when ratcheting is not desired; and a wrench variation wherein the adjustment screw is eliminated and the jaw is simply moved into engagement with a nut via a slide button.

Lopez, U.S. Pat. No. 8,485,073, discloses a viper crescent wrench device for holding a work piece. Upon squeezing a second handle toward a first handle, a first pawl and a second pawl move an adjusting bar toward the first handle thereby moving a second jaw portion toward a first jaw portion. Upon releasing the second handle, the first pawl and the second pawl releasably lock into place and the second handle readjusts relative to the first pawl thereby repositioning to do the same action again when the second handle is squeezed again until the work piece is secured between the first jaw portion and the second jaw portion. Upon rotation of a release mechanism, toothed notches are rotated out of contact with the first pawl and the second pawl such that the second jaw portion moves away from the first jaw portion under bias of a first spring thereby releasing the work piece.

Shishkin, et al, U.S. Pat. No. 8,925,426, discloses an adjustable nut wrench comprising a handle section and a slide guided element that is pushed by a spring to a position where abutment surfaces are paralleled to two or three sides of a nut. A first embodiment of the wrench comprises two paralleled abutment surfaces which set by the angle of maximal 60 degrees to a direction of the sliding element movement. A second embodiment of the wrench has three abutment surfaces located by the angle of 60 degrees to each other and one of them is sliding.

Arbel, et al, U.S. Published Patent Application 2011/0239832, discloses adjustable wrenches, including a ring wrench, an open end wrench and a pipe wrench, for loosening and tightening bolts having heads of various sizes, while they grip the head of the bolt. The wrenches are adjusted to fit the bolt in a continuous movement, at the end of which the wrench is locked precisely on the bolt, and requires only one hand to be used for loosening and tightening the bolt, without damaging the bolt.

SUMMARY OF THE INVENTION

The present invention overcomes the aforementioned problems, and is distinguished over the prior art in general, and these patents in particular, by an adjustable open ended wrench with bidirectional jaw release action which includes a base member having a longitudinal handle portion and a fixed first jaw protruding perpendicularly from a front end of the handle portion, an internally threaded retainer member at a rear end of the handle portion, and a longitudinal guide slot extending from a rear end of the handle portion above the retainer member terminating a distance from the fixed jaw. A movable jaw member slidably mounted in the handle portion has a movable second jaw protruding perpendicularly from a front end thereof and a longitudinal guide rail portion extending from a rear end thereof terminating adjacent to the second jaw, the guide rail portion slidably received in the guide slot for longitudinal movement relative to the handle portion, and a plunger travel hole extending perpendicularly through the guide rail portion having a smaller diameter bore defining a radial stop shoulder at one end thereof. A plunger member having a larger diameter end is slidably received in the plunger travel hole beneath the stop shoulder and has a stem portion extending from the larger diameter end through the smaller diameter bore and terminates a distance perpendicularly outward from the movable jaw member guide rail portion, a push button on an outer end of the stem portion. A compression spring surrounds the said stem portion between the guide rail and the push button to spring bias the plunger to a normally extended position with the larger diameter end retracted in the plunger travel hole.

A sliding adjustment member slidably mounted in the handle portion beneath the movable jaw member has a longitudinal front portion extending from a front end terminating in a generally rectangular rear portion, a plunger receiving hole extending perpendicularly through the longitudinal front portion. The adjustment member is slidable relative to the handle portion and the movable jaw member. An extension spring disposed between the movable jaw member and the adjustment member spring biases the movable jaw member and the adjustment member normally together with the plunger travel hole and plunger receiving hole in axial alignment. An adjustment screw having an elongate threaded shank is threadedly engaged in the threaded retainer member at said rear end of the handle portion and has a front end rotatably connected with the generally rectangular rear portion of the adjustment member and a knob at a rear end of the threaded shank.

The distance between the fixed first jaw and the movable second jaw is selectively adjusted by turning the adjustment screw to fit opposed flats of a nut or bolt head to be tightened or loosened, the plunger is depressed to engage its larger diameter end in the plunger receiving hole of the adjustment member and lock the movable second jaw in place to grip the opposed flats and rotate the nut or bolt head when the wrench is turned in a clockwise or counter clockwise direction. The plunger is released to retract its larger diameter end out of the plunger receiving hole, and allow the movable jaw member to move rearward relative to the adjustment member and thereby release the grip of the first second jaws on the opposed flats of the nut or bolt head and, upon further rotation of the wrench in a clockwise or counter clockwise direction, while the first and second jaws are still on the flats of the nut or bolt head, the spring becomes extended to allow the jaws to pass over the corners of the nut or bolt head, after which the extension spring quickly contracts such that the jaws once again engage and grip a different set of opposed flats. The plunger is depressed again to lock said movable jaw in place to grip the different sets of opposed flats and further rotate the nut or bolt head.

In another embodiment, the internally threaded retainer member is slidably mounted at the rear end of the base member longitudinal handle portion and is releasably retained by a torque release spring biased ball detent mechanism that can be set to correspond to an amount of torque needed to seat the bolt or nut, and to release the movable retaining block to move rearward which then releases the gripping force on the movable second jaw the when the amount of force against the movable second jaw is achieved to prevent damage due to over tightening.

One of the significant features and advantages of the present invention is that it allows a user to loosen or tighten a bolt or nut without having to remove the wrench.

Another feature and advantage of the invention is that the gripping jaws will fit both inch and metric size bolts and nuts.

Another feature and advantage of the invention is that the gripping jaws allow easy access to bolts or nuts that are located in areas where the rotational action of the nut or bolt is very restricted.

Another feature and advantage of the invention is that the wrench provides a bidirectional release action of the gripping jaws.

Another feature and advantage of the invention is that, in one embodiment, the amount of torque applied can be adjusted by the user to release the grip of the gripping jaws if the gripping force exceeds a predetermined amount.

Other features and advantages will become apparent from time to time throughout the specification and claims as hereinafter related.

DETAILED DESCRIPTION OF THE INVENTION

Figure 1:
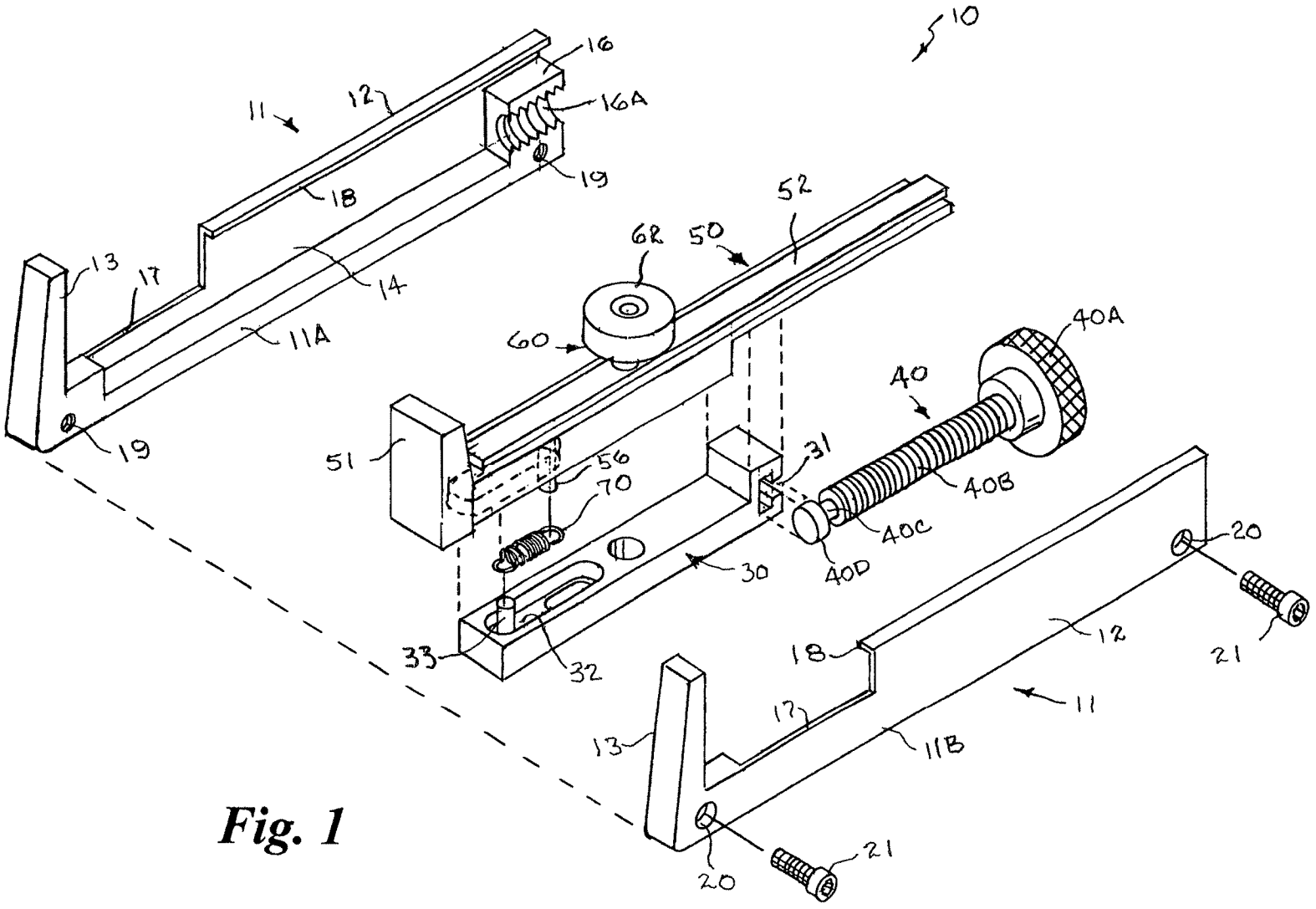
FIG. 1 is an exploded perspective view of the adjustable open ended wrench with bi-directional release action in accordance with the present invention, shown with the major components in an unassembled condition.

In the following discussion, for ease of understanding, the terms "front", "rear", "top", "bottom", and "side" as used in conjunction with the components refer to the position, location, or orientation of the components as they are depicted in the drawings. For example, the jaws are shown at the front end and the adjustment screw is shown at the rear end of the wrench.

FIG. 1 shows the major components of a preferred embodiment of the adjustable open ended wrench 10 with bi-directional release action, with the major components in an unassembled condition. The major components of the wrench 10 include: a base member and fixed jaw assembly 11, formed by a pair of opposed base plate members 11A and 11B, each having a longitudinal handle portion 12 and a protruding fixed jaw portion 13 at the front end that are assembled together in opposed relation as described hereinafter, an adjustment member 30, an adjustment screw 40, a movable jaw 50, a plunger 60, an extension spring 70, and a pair of socket head cap screws 21 that secure the base plate members 11A and 11B together.

Figure 2:
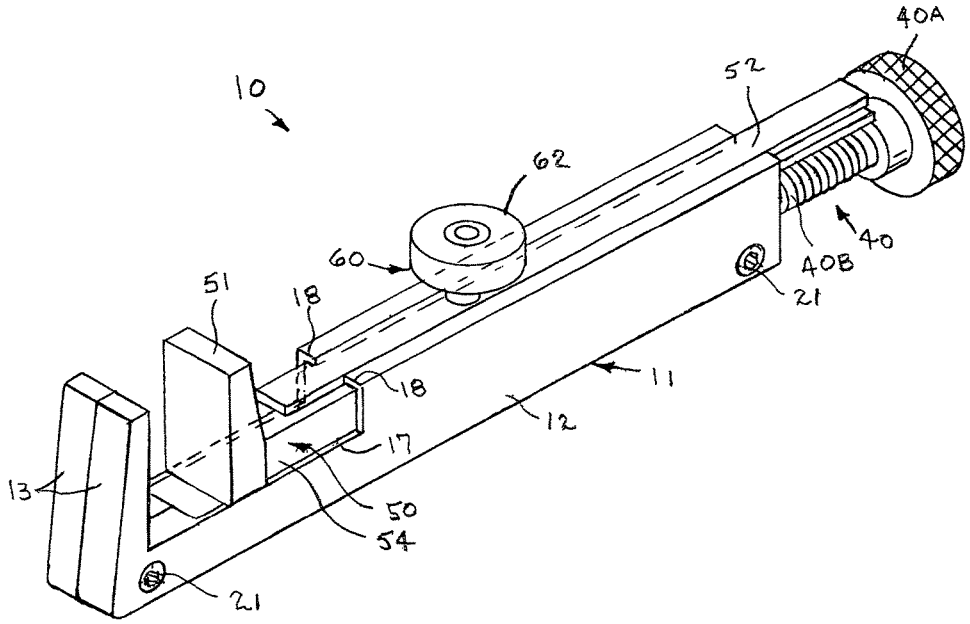
FIG. 2 is a perspective view of the adjustable open ended wrench in an assembled condition, shown with the gripping jaws in an open position.

Referring additionally to FIG. 2, the adjustable open ended wrench 10 is shown in an assembled condition, and referring to FIGS. 3-6, the components and their relationship are described in detail.

The wrench 10 is assembled by placing the movable jaw member 50 on top of the adjustment member 30 with one end of the extension spring 70 installed on a downwardly extending pin 56 at the rear end of a longitudinal recess 55 in the bottom of the movable jaw member 50 and its opposed end installed on the upwardly extending pin 33 at the forward end of a longitudinal recess 32 in the adjustment member 30, such that the extension spring is disposed in a cavity formed by the opposed facing longitudinal recesses 55 and 32 in the adjustment member and movable jaw member. These components are described in detail hereinafter.

The adjustment member 30 and movable jaw member 50 are placed into a generally rectangular longitudinal recess 14 formed in the inner side wall of the handle portion 12 of one of the base plate members 11A. A reduced diameter neck portion 40C and adjoining larger diameter head portion 40D of the adjustment screw 40 are placed into a transverse T-shaped slot 31 of the adjustment member 30 and the threaded shank 40 of the adjustment screw into a threaded portion 16A of a retaining block 16 at the rear end of the handle portion 12 of the base plate member 11A.

The other one of the base plate members 11B is then placed onto the base plate 11A containing the assembled components such that bores and counterbores 20 of the base plate 11B are axially aligned with threaded bores 19 of the base plate 11A, and the socket head cap screws 21 are installed to secure the base plates together and slidably contain the components within the base member and fixed jaw assembly 11.

As described briefly above, the base member and fixed jaw assembly 11 is formed by a pair of opposed base plate members 11A and 11B which are substantially mirror images of one another, and are assembled together in opposed relation, as described above. Each base plate member 11A and 11B has an elongate generally rectangular handle portion 12 and a protruding fixed jaw portion 13 extending perpendicularly outward therefrom at a front end thereof. A generally rectangular longitudinal recess 14 is formed in the inner side wall of the each handle portion 12 a short distance from each end defining a shoulder 15 adjacent to the protruding fixed jaw portion 13, and a generally rectangular retaining block 16 at the rear end of the handle portion. The outer side wall of each base plate member 11A and 11B is provided with a generally rectangular cutaway portion 17 that extends a relatively short distance from the fixed jaw portion 13 toward the rear end of the handle portion 12. The top end of the outer side wall has a short inward facing retaining lip 18 that extends from the cutaway portion 17 to the rear end of the handle portion 12 a short distance above the rectangular retaining block 16 at the rear end of the handle portion.

One of the base plate members 11A or 11B is provided with a transverse threaded bore 19 near each end, and the other plate member is provided with an axially aligned transverse bore and counterbore 20 for receiving socket head cap screws 21 to secure the base plate members together.

The generally rectangular retaining block 16 at the rear end of the handle portion 12 is provided with internal threads 16A that extend therethrough between the longitudinal recess 14 and the exterior of the handle portion 12. The internally threaded portion 16A may be formed by securing the base plate members 11A, 11B, together such that the retaining blocks 16 are abutting face-to-face, forming the threads 16A through the adjoined retaining blocks, and then separating the base plate members 11A, 11B, such that each retaining block has half of the treaded bore.

The adjustment member 30 is an elongate generally rectangular member having a protruding rectangular portion 30A at a rear end thereof which has a T-shaped slot 31 extending transversely therethrough, and a longitudinal recess 32 formed near the front end thereof. A pin 33 is secured at the forward end of the recess 32 and extends perpendicularly outward a short distance therefrom. A short longitudinal slot 32A extends through the recess 32 at the rear end thereof. A plunger receiving hole 34 extends through the adjustment member 30 a short distance rearward from the longitudinal recess 32.

The adjustment screw 40 has a knob 40A at a rear end, an elongated threaded shank 40B extending forwardly from the knob and terminating in a reduced diameter neck portion 40C and an adjoining larger diameter head portion 40D at the front end. The reduced diameter neck portion 40C and adjoining larger diameter head portion 40D are sized to be slidably received in the transverse T-shaped slot 31 of the adjustment member 30.

The movable jaw member 50 is an elongate generally rectangular member having an inverted generally T-shaped transverse cross section with a protruding jaw portion 51 extending perpendicularly outward therefrom at a front end thereof. The narrower top portion of the T-shape defines a narrow guide rail 52 that extends from the rear end of the movable jaw member 50 and terminates a short distance from the protruding jaw portion 51. When the base plate members 11A, 11B are assembled, the guard rail 52 is slidably disposed in the space between the inward facing retaining lips 18 of the base plates. The wider lower portion of the movable jaw member 50 is provided with a cutaway portion that extends a distance from rear end defining a vertical shoulder 53 and slightly larger generally rectangular bottom portion 54 that extends forwardly beneath the guide rail 52 and adjoins the back side of the protruding jaw portion 51.

A longitudinal recess 55 is formed in the underside of the bottom portion 54 of the movable jaw member 50 near the front end thereof. A pin 56 is secured at the rearward end of the recess 55 and extends perpendicularly outward a short distance therefrom. A plunger travel hole 57 disposed a short distance rearward of the longitudinal recess 55 in the underside of the rectangular bottom portion 54 of the movable jaw member 50 extends upwardly a distance from the bottom of the rectangular bottom portion and terminates in a smaller diameter bore that extends through the top of the guide rail 52 defining a radial stop shoulder 58.

The plunger member 60 has a larger diameter bottom portion 60A and a smaller diameter stem portion 60B extending upwardly therefrom. The bottom portion 60A is slidably received in the plunger travel hole 57 with the stem portion 60B extending upwardly through the smaller diameter radial stop shoulder 58. The stem portion 60B extending above the top of the guide rail 52 is surrounded by a compression spring 61, and a push button 62 is secured to the top end of the stem to capture the ends of the compression spring between the bottom of the push button and the top of the guide rail, such that the push button and plunger are biased upwardly in a normally upwardly extended position with the larger diameter bottom portion of the plunger disposed in the plunger travel hole 57.

The extension spring 70 has one end installed on the downwardly extending pin 56 at the rear end of the longitudinal recess 55 in the bottom of the movable jaw member 50 and its opposed end is secured to the upwardly extending pin 33 that is disposed at the forward end of the longitudinal recess 32 in the adjustment member 30. When the movable jaw member 50 is placed on top of the adjustment member 30, the opposed facing longitudinal recesses 32 and 55 form a cavity in which the extension spring 70 resides.

Operation

Figure 3:
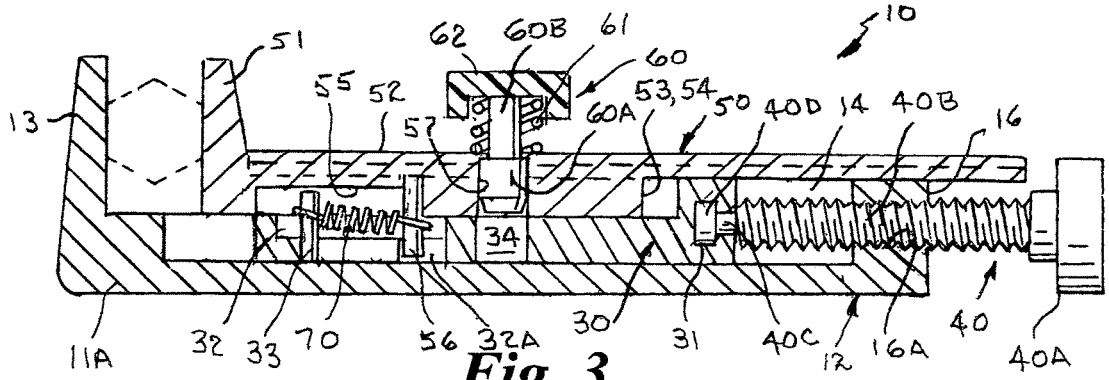
FIG. 3 is a longitudinal cross sectional view of the adjustable open ended wrench, taken along line 3-3 of FIG. 2, shown with the gripping jaws in an open position and the plunger in a normally extended position disengaged from the adjustment member.
Figure 4:
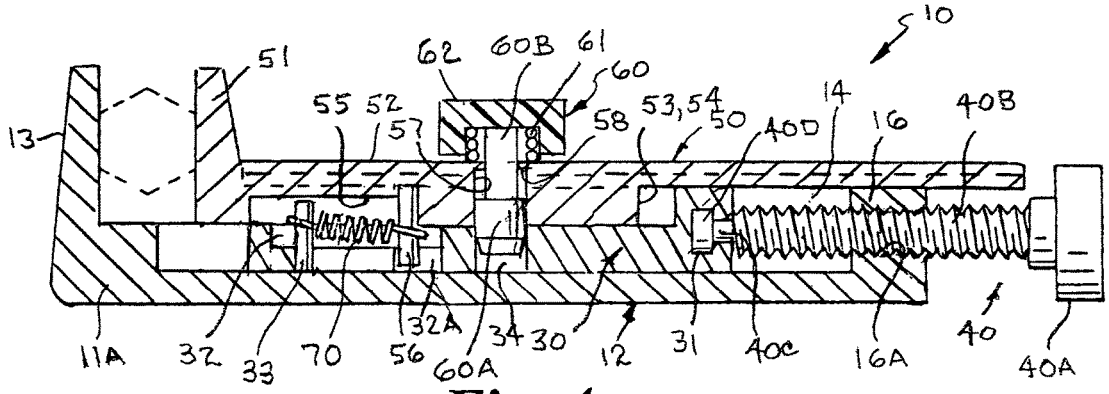
FIG. 4 is a longitudinal cross sectional view of the adjustable open ended wrench, similar to FIG. 3, shown with the plunger in a depressed position engaged with the adjustment member to prevent relative movement between the movable jaw member and the adjustment member in a grip release lock-out condition.
Figure 5:
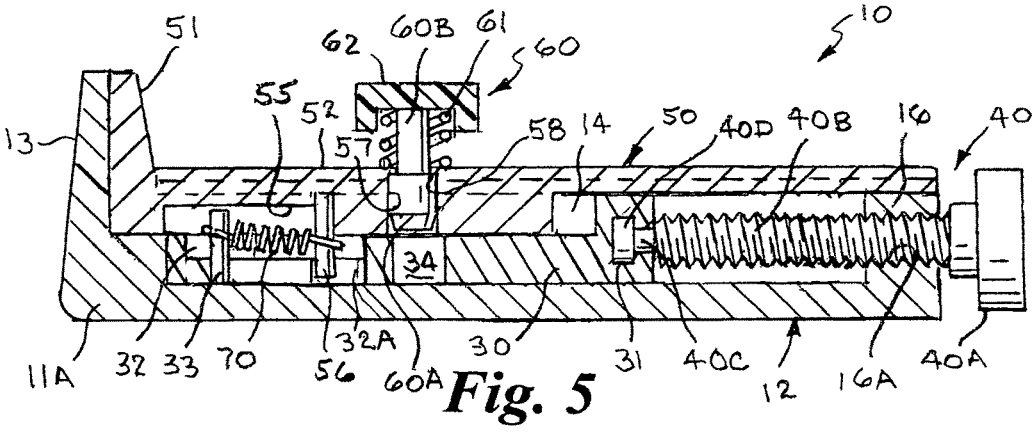
FIG. 5 is a longitudinal cross sectional view of the adjustable open ended wrench, similar to FIG. 3, shown with the gripping jaws in a closed position.

As seen in FIG. 5, the face of the movable jaw 50 is in contact with the fixed jaw 13. The opening or space between the fixed jaw 13 and movable jaw 50 is adjusted by turning the adjustment screw 40 to open or close the jaws to fit the flats of the nut or bolt head to be turned in a clockwise or counter clockwise direction as shown in FIG. 3. When the plunger 60 is depressed, as seen in FIG. 4, the larger diameter end of the plunger is engaged in the plunger receiving hole 33 of the adjustment member 30, and the movable jaw 50 is locked in place, gripping the flats of the nut or bolt head to rotate the nut or bolt head when the wrench 10 is turned in a clockwise or counter clockwise direction.

Figure 6:
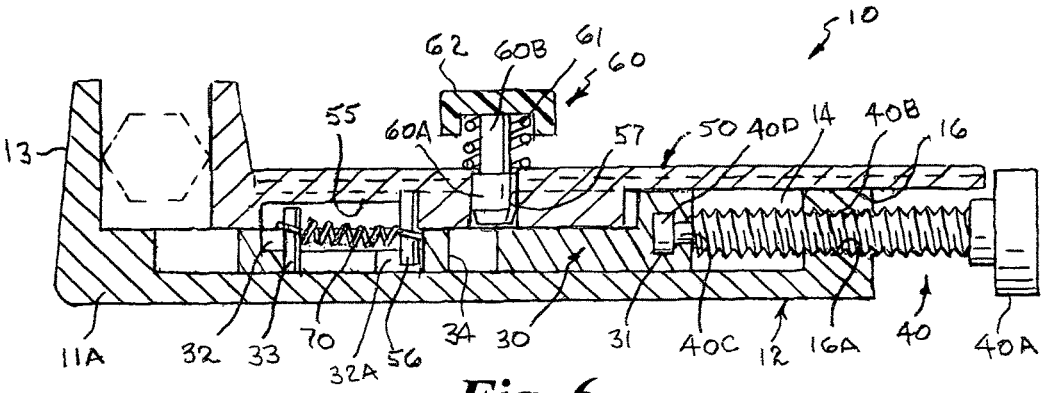
FIG. 6 is a longitudinal cross sectional view of the adjustable open ended wrench, similar to FIG. 3, shown with the extension spring in an extended position during the bi-directional grip release action.

As seen in FIG. 6, when the plunger 60 is released, it moves upward out of the hole 33 of the adjustment member 30, and the movable jaw 50 is free to move rearward relative to the adjustment member 30 and, thus, releasing the grip of the jaws on the nut or bolt head held between the jaws. When the plunger 60 is released, the wrench can then be rotated while the jaws are still on the nut or bolt head in a clockwise or counter clockwise direction relative to the nut or bolt head. As the wrench 10 rotates, the jaws pass over the corners of the nut or bolt head, the extension spring 70 mounted between the pins 33 and 56 of the adjustable member and movable jaw 50, and the adjustment member 30 becomes extended and then the spring quickly contracts after the jaws pass over the corners, such that the jaws once again engage and grip a different set of flats. The plunger 60 can then be depressed again to lock the movable jaw in place gripping the flats of the nut or bolt head to rotate the nut or bolt head.

Figure 7:
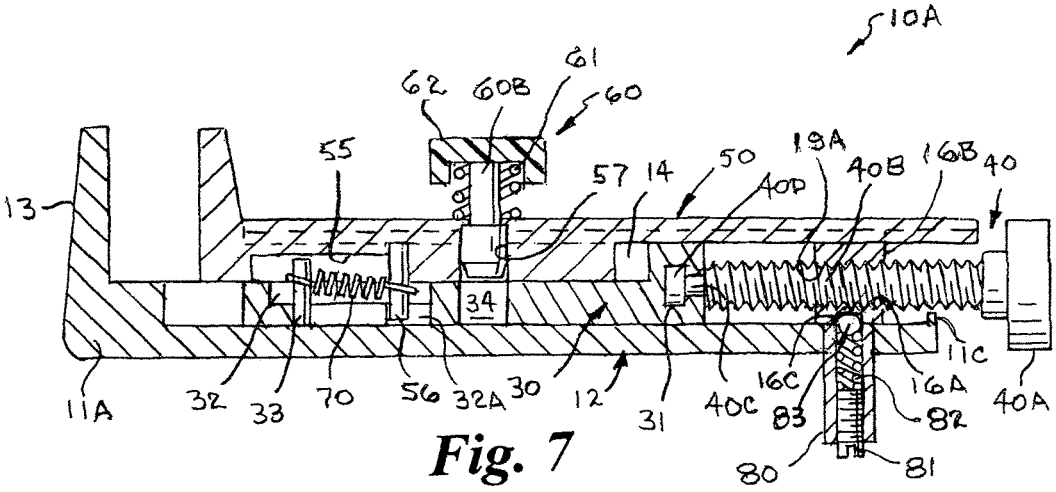
FIG. 7 is a longitudinal cross sectional view of an alternate embodiment of the adjustable open ended wrench, similar to FIG. 3, having a torque release modification that allows adjustment of the amount of torque to be applied to release the grip of the gripping jaws if the gripping force exceeds a predetermined amount.

Referring now to FIG. 7, there is shown an alternate embodiment of the adjustable open ended wrench 10 which has a torque release modification that allows adjustment of the amount of torque to be applied to release the grip of the gripping jaws if the gripping force exceeds a predetermined amount. The components that are the same or similar to those shown and described in detail in the previous embodiment are assigned the same numerals of reference, but some of the components will not be described again in detail to avoid repetition.

In this embodiment, the generally rectangular retaining block members 16 at the rear end of the handle portion 12 of the base plate members 11A and 11B are replaced by a movable retaining block 16B having a threaded bore 19A therethrough that is slidably mounted between the base plate members, and each of the base plate members has a retaining end wall 11C spaced a distance rearwardly from the movable retaining block. The bottom wall of each base plate member has a small semicircular aperture therethrough disposed a distance forward of the end wall 11C which forms a hole when the base plate members are secured together. A generally wedge-shaped slot 16C having a straight rearward facing side wall and a tapered front facing side wall extends transversely across the bottom of the movable retaining block 16B.

A tubular member 80 is press fitted or otherwise secured in the hole in the bottom of the base plate members 11A, 11B. An adjustable set screw 81 is threadedly engaged in an internally threaded portion in the bottom end of the tubular member 80. A compression spring 82 is supported in the tubular member 80 at the top end of the set screw 81. A ball bearing 83 at the top end of the compression spring 82 is urged into spring biased engagement with the generally wedge-shaped slot 16C. The adjustable set screw 81 can be rotated to apply a selective force on the compression spring 82 by turning the set screw either in a clockwise direction to apply more pressure or counter-clockwise direction to apply less pressure on the ball bearing 83.

The torque release action works as follows: When a nut or bolt head is tightened in a clockwise direction, the force against the face of the movable gripping jaw 50 increases as the nut or bolt head or nut reaches its end of travel. When the nut or bolt head reaches its end of travel, the force against the face of the movable gripping jaw 50 increases significantly until the angled surface of the wedge-shaped slot 16C forces the ball bearing 83 downward against the spring force of the compression spring 82. When the spring force of the compression spring 82 has been exceeded, the ball bearing 83 is forced downward and releases the movable retaining block 16B so that it can move rearward, which then releases the gripping force on the movable gripping jaw 50.

By varying the spring force of the compression spring 82 by either adjusting the set screw 81, or using a thicker spring material, the release point of the movable gripping jaw can be set at the amount of torque needed to seat the bolt or nut at the proper pressure, or can be used as a means of releasing the gripping jaw before a fitting is damaged due to over tightening.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. An adjustable open ended wrench with bidirectional jaw release action, comprising:

a base member having a longitudinal handle portion with a fixed first jaw protruding perpendicularly from a front end of said handle portion, an internally threaded retainer member at a rear end of said handle portion, and a longitudinal guide slot extending from a rear end of said handle portion above said retainer member and terminating a distance from said first jaw;

a movable jaw member slidably mounted in said handle portion having a movable second jaw protruding perpendicularly from a front end thereof and a longitudinal guide rail portion extending from a rear end thereof and terminating adjacent to said second jaw, said guide rail portion slidably received in said guide slot for longitudinal movement relative to said handle portion, and a plunger travel hole extending perpendicularly through said longitudinal guide rail portion having a smaller diameter bore defining a radial stop shoulder at one end thereof;

a plunger member having a larger diameter end slidably received in said plunger travel hole beneath said stop shoulder, a stem portion extending from said larger diameter end, through said smaller diameter bore, and terminating a distance perpendicularly outward from said movable jaw member longitudinal guide rail portion, a push button on an outer end of said stem portion, and a compression spring surrounding said stem portion between said guide rail portion and said push button to spring bias said plunger to a normally extended position with said larger end retracted in said plunger travel hole;

a sliding adjustment member slidably mounted in said handle portion beneath said movable jaw member having a longitudinal front portion extending from a front end terminating in a generally rectangular rear portion, a plunger receiving hole extending perpendicularly through said longitudinal front portion, said adjustment member slidable relative to said handle portion and said movable jaw member;

an extension spring disposed between said movable jaw member and said adjustment member to spring bias said movable jaw member and said adjustment member normally together with said plunger travel hole and said plunger receiving hole in axial alignment; and an adjustment screw having an elongate threaded shank threadedly engaged in said threaded retainer member at said rear end of said handle portion, with a front end rotatably connected with said generally rectangular rear portion of said adjustment member, and a knob at a rear end of said threaded shank; wherein the distance between said fixed first jaw and said movable second jaw is selectively adjusted by turning said adjustment screw to fit opposed flats of a nut or bolt head to be tightened or loosened, said plunger is depressed to engage said larger diameter end in said plunger receiving hole of said adjustment member, and lock said movable second jaw in place to grip the opposed flats and rotate the nut or bolt head when said wrench is turned in a clockwise or counter clockwise direction;

said plunger is released to retract said larger diameter end out of said plunger receiving hole, and allow said movable jaw member to move rearward relative to said adjustment member and thereby release the grip of said fixed first jaw and said second movable jaw on the opposed flats of the nut or bolt head and upon further rotation of said wrench in a clockwise or counter clockwise direction, while said first and said second jaws are still on the flats of the nut or bolt head, said extension spring becomes extended to allow said jaws to pass over the corners of the nut or bolt head, after which said extension spring quickly contracts such that said jaws once again engage and grip a different set of opposed flats; and said plunger is depressed again to lock said movable jaw in place to grip the different sets of opposed flats and further rotate the nut or bolt head.

2. The adjustable open ended wrench with bidirectional jaw release action according to claim 1, wherein said internally threaded retainer member is slidably mounted at said rear end of said base member longitudinal handle portion and is releasably retained by an adjustable torque release spring biased ball detent mechanism that can be set to correspond to an amount of torque needed to seat the bolt or nut, and to release said movable retaining block to move rearward which then releases the gripping force on said movable second jaw the when the amount of force against said movable second jaw is achieved to prevent damage due to over tightening.

3. The adjustable open ended wrench with bidirectional jaw release action according to claim 2, wherein said longitudinal handle portion has a hole extending through a bottom wall thereof, said internally threaded retainer member has a generally wedge-shaped transverse slot in a bottom surface thereof with a straight side wall and an angled side wall; and said torque release spring biased ball detent mechanism comprises a tubular member having a first end mounted in said hole, an adjustable set screw threadedly engaged in an internally threaded portion in a second end, a compression spring in said tubular member having one end supported at one end of said set screw, a ball bearing at an opposed end of said compression spring to urged said ball bearing into spring biased engagement with said generally wedge-shaped slot;

said adjustable set screw being rotated to apply a selective force on said compression spring and pressure on said ball bearing.

* * * * *